United States Patent [19]

Sakurada et al.

[11] Patent Number: 4,466,990

[45] Date of Patent: Aug. 21, 1984

[54] HEAT-RESISTANT FIBER AND/OR FIRE RETARDANT SYNTHETIC FIBER

[75] Inventors: Ichiro Sakurada, Kyoto; Kanako Kaji, Osaka; Toshio Okada, Kadoma, all of Japan

[73] Assignee: Japan Atomic Energy Research Institute, Tokyo, Japan

[21] Appl. No.: 367,476

[22] Filed: Apr. 12, 1982

Related U.S. Application Data

[63] Continuation-in-part of Ser. No. 136,948, Apr. 3, 1980, abandoned.

[51] Int. Cl.[3] ..... B05D 3/06

[52] U.S. Cl. ..... 427/35; 427/44

[58] Field of Search ..... 427/35, 44, 36, 37

[56] References Cited

U.S. PATENT DOCUMENTS 3,088,791 5/1963 Cline et al. ..... 427/35

3,188,165 6/1965 Magat et al. ..... 427/44

*Primary Examiner*—John H. Newsome

*Attorney, Agent, or Firm*—Posnack, Roberts, Cohen Spiecens

[57] ABSTRACT

A heat resistant and/or fire retardant synthetic fiber is obtained by a process comprising immersing a polyethylene fiber into a solution of acrylic acid or impregnating a polyethylene fiber with a solution of acrylic acid and irradiating the polyethylene fiber with an ionizing radiation to graft polymerize the polyethylene fiber with at least 15%, based on the weight of the polyethylene fiber, of acrylic acid, or a process comprising irradiating a polyethylene fiber with an ionizing radiation and then immersing the polyethylene fiber into a solution of acrylic acid or impregnating the polyethylene fiber with a solution of acrylic acid to graft polymerize the polyethylene fiber with at least 15%, based on the weight of the polyethylene fiber, of acrylic acid.

14 Claims, 1 Drawing Figure

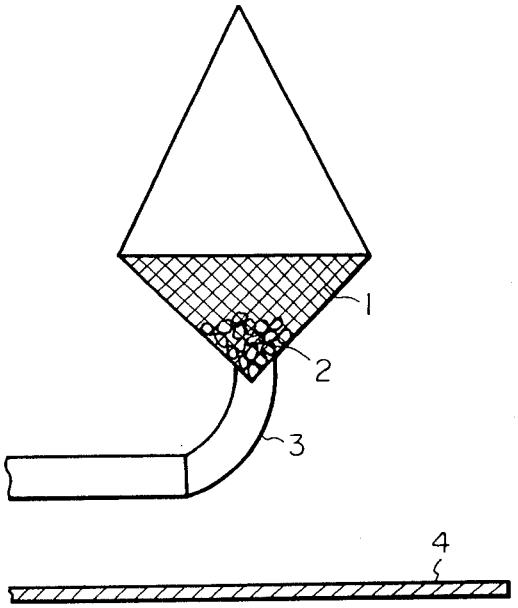
1
2
3
4

HEAT-RESISTANT FIBER AND/OR FIRE RETARDANT SYNTHETIC FIBER

This application is a continuation-in-part of Ser. No. 136,948 filed Apr. 3, 1980 now abandoned.

BACKGROUND OF THE INVENTION

The present invention relates to a heat-resistant and/or fire-retardant synthetic fiber. More particularly, the present invention relates to a polyethylene fiber excellent in heat resistance and/or fire retardance. The present invention also relates to a process for preparing such fiber.

Polyethylene fiber is inexpensive and not only has excellent strength properties which particularly are unchanged even in water but also has various excellent properties such as resistance to acids, resistance to alkalis and resistance to organic solvents so that it is widely used as industrial materials such as a filter fabric, and further it is also widely utilized as a fishing net because it is excellent in water resistance and highly stable for use in seawater. However, polyethylene fiber is limited in its use since it undergoes heat distortion such as heat shrinkage, etc. when heated at 70° C., melts at 110° to 120° C. and loses the form of fiber entirely at 140° C. Further, polyethylene fiber is hydrophobic as a property common to synthetic fibers and is difficult to dye, and it also has the deficiency of easily causing frictional static electrification.

If the stability of polyethylene to heating is improved without damaging its excellent mechanical properties, the use of polyethylene fiber will be enlarged by this alone. It has been known to irradiate polyethylene with an ionizing radiation such as γ-rays and electron beams with 5 to 50 Mrad to form a cross linkage for the purpose of improving the heat stability of polyethylene. This method is effective for preventing polyethylene from melting at its melting point (135° to 140° C.), but the method is unsatisfactory for preventing the heat distortion of fibrous polyethylene. A polyethylene fiber easily catches fire, melts and burns on contact with a flame since the fiber is a high molecular weight material composed of carbon and hydrogen only. In recent years from a viewpoint of safety, a problem to be urgently solved is to make fiber materials hard to burn. If it becomes possible to make a polyethylene fiber hard to burn, the range of use will be remarkably enlarged.

It has hitherto been known to add and blend a halogenated compound, a phosphorus-containing compound or antimony oxide or to react with a compound containing a halogen or phosphorus to make a high molecular weight material such as polyethylene hard to burn. A halogen, phosphorus, antimony, etc. are known as elements making high molecular material hard to burn.

As a result of research on the stability of polyethylene fiber to heating, the present inventors have found that, when graft polymerizing polyethylene fiber with acrylic acid or, after graft polymerization, by converting it to a salt of a mono-valent metal such as sodium, potassium, lithium, etc., a salt of a divalent metal such as calcium, zinc. etc. or a salt of a trivalent metal such as aluminum, etc., if the graft percent is more than 15% the grafted polyethylene fiber becomes fire retardant, and if the graft percent is more than 20% heat shrinkage barely occurs and, in particular, if the graft percent is more than 30% an improved polyethylene fiber having excellent mechanical properties which is not melt broken even by heating to 300° C. can be obtained.

SUMMARY OF THE INVENTION

According to the present invention a synthetic fiber which is excellent in fire retardance and/or heat resistance can be prepared by immersing a polyethylene fiber into an aqueous solution of acrylic acid or a mixed solution to which is added an organic solvent having a swelling effect for polyethylene, or impregnating the polyethylene fiber with the aqueous solution or the mixed solution and irradiating the immersed or impregnated polyethylene fiber with an ionizing radiation, or contacting a polyethylene fiber irradiated with an ionizing radiation previously with an aqueous solution of acrylic acid or a mixed solution to which is an added an organic solvent having a swelling effect for polyethylene, to graft polymerize the polyethylene fiber with at least 15% on the basis of the weight of polyethylene fiber, of acrylic acid, or further, after the graft polymerization, converting the grafted polymer to a polyacrylic acid salt of mono-valent, divalent or trivalent metal.

DETAILED DESCRIPTION OF THE PREFERRED EMBODIMENTS

In one process of the present invention, a polyethylene fiber is immersed in or impregnated with an aqueous solution of acrylic acid or a mixed solution having a swelling agent for polyethylene, such as ethylene dichloride, added to the acrylic acid aqueous solution and irradiated with an ionizing radiation to be graft polymerized with acrylic acid. For example, a mixed solution of acrylic acid, water and ethylene dichloride is prepared by adding an amount of ethylene dichloride less than an amount such that the solution, after the immersion of fiber, undergoes phase separation to an aqueous acrylic acid solution. In this case ethylene dichloride has a property of accelerating the diffusion of acrylic acid into polyethylene to increase the rate of graft polymerization and is particularly effective when using a high dose rate of ionizing radiation, or when the polyethylene used has a high degree of crystallization. In order to suppress the formation of homopolymer of acrylic acid during the graft polymerization thereof, the acrylic acid aqueous solution or the mixed solution having a swelling agent added thereto is preferably supplied with a small amount of a water soluble ferrous salt such as Mohr's salt (ferrous ammonium sulfate), a water soluble cupric salt such as copper sulfate, or a water soluble cuprous salt such as cuprous chloride so that the concentration of salt is up to $10^{-1}$ mole/l, based on the weight of solution.

As an ionizing radiation an electron beam from an accelerator, γ-rays from $^{60}Co$ and X-rays from an X-ray generating apparatus are conveniently employed. The dose rate used is preferably $10^4$ to $10^7$ rad/sec in the case of electron beams and $10^3$ to $10^6$ rad/hour in case of γ-rays or X-rays, and the dose is preferably $1\times10^3$ to $1\times10^7$ rad, particularly $1\times10^4$ to $5\times10^6$ rad. The irradiation temperature is 40° to 80° C. If the irradiation temperature is less than 40° C., even with irradiation for a long time, only homopolymer of acrylic acid is produced and the rate of graft polymerization will not reach 10%. Above 80° C. there is no improvement in the graft percent of polymerization and therein beginning of degradation of the graft polymer.

For a certain object it is particularly effect for improving the heat resistance of polyethylene fiber to convert the grafted polymer to a polyacrylic acid salt. The fire retardance of polyethylene fiber is not substantially damaged by the converting treatment. The molecular chain of grafted polyacrylic acid is converted to that of sodium polyacrylate by immersing a grafted fiber into an aqueous solution of 1% caustic soda. When using lithium hydroxide or potassium hydroxide in place of caustic soda, it can be converted to lithium polyacrylate or potassium polyacrylate. And when using a salt of a weak acid such as calcium acetate, zinc acetate, etc. in place of converting to these mono-valent alkali metal salts, the molecular chain of grafted polyacrylic acid can be converted to a divalent metal salt such as a calcium salt, a zinc salt, etc., respectively. Quite similarly, it can be converted to a trivalent aluminum salt of polyacrylic acid by using aluminum acetate. And also when converting a divalent metal salt or a trivalent metal salt, after conversion to a monovalent metal salt such as a sodium salt, a potassium salt, etc., it may be immersed into an aqueous solution of a divalent metal salt or trivalent metal salt to convert it to a divalent metal salt or a trivalent metal salt, respectively. In this case, for example, by using an aqueous solution of calcium chloride, zinc chloride, etc., it can be converted to the calcium salt, the zinc salt, respectively.

In the second process of the present invention, a polyethylene fiber is irradiated with an ionizing radiation and thereafter is contacted with an aqueous solution of acrylic acid or a mixed solution having added thereto an organic solvent having a swelling effect for polyethylene, for example, a mixed solution of acrylic acid, water and ethylene dichloride to be graft polymerized with acrylic acid. In this method, the ionizing radiation can be an electron beam and $\gamma$-rays and the electron beams from an accelerator are particularly preferable. Although the dose rate is not particularly limited, in the case of the electron beam, it is preferably $1\times10^4$ to $5\times10^7$ rad/sec and the dose is preferably 1 to 30 Mrad. It is preferable to add $10^{-4}$ to $10^{-1}$ mole/l of a salt having a property of preventing the polymerization of acrylic acid, such as Mohr's salt to an acrylic acid aqueous solution or a mixed solution of acrylic acid, water and ethylene dichloride which is contacted with polyethylene for graft polymerization after irradiation. The irradiation temperature must be at least 40° C. or the rate of graft polymerization will only reach about 10% even with long irradiation periods.

Also in the second process for a certain object, an improved polyethylene fiber excellent in heat resistance can be obtained by converting the polyethylene fiber graft polymerized with acrylic acid to a monovalent metal salt such as the lithium, sodium, potassium salt, etc., a divalent metal salt such as the calcium, zinc salt, etc. or a trivalent metal salt such as the aluminum salt in the same manner as shown in the first process.

Acrylic acid which is used in the present invention is given by the formula $CH_2{=}CHCOOH$ which does not contain a fire retarding element. Therefore, it has been quite unanticipated that fire retarding by graft polymerization of acrylic acid is possible. The present invention seeks to apply this to fibrous polyethylene and is to improve the heat stability of polyethylene fiber without damaging the strength properties to provide a fire retardant and/or heat resistant polyethylene fiber.

The heat resistance and/or fire retardation is measured by a number of properties of the fiber including: a self-extinguishing flame property in which the extinction time of a flame of the fiber is less than 7 seconds; an amount of unburned material after burning of at least 43%; and no melting of the fiber to form droplets; the fiber having high shrinkability resistance wherein the degree of shringage is no greater than 60% at 150° C., high breakage resistance in which the breaking temperature is no less than 205° C. and high melting temperature no less than 205° C.

It has been unanticipated from prior knowledge that a monovalent alkali metal salt such as the lithium salt, sodium salt, potassium salt, etc. of acrylic acid grafted in the present invention is effective for improving the heat resistance of polyethylene. It has been know to improve the heat resistance of ethylene-acrylic acid copolymers by ionic crosslinking between diavalent molecules using a divalent metal salt such as calcium, etc. however, since ionic crosslinking is not considered in monovalent metal salts, it is assumed to be due to a structure change different from that in divalent metal salts. In particular, in the lithium and sodium salts there is an effect of not only improving heat resistance but also remarkably increasing the hydrophilic nature. The fire retardance of the graft polymer is not substantially lowered by the converting treatment with metal salt, and polyethylene fiber grafted with polyacrylic acid salt is almost the same as the fiber grafted with acrylic acid in fire retardance and fire-extinguishing properties and sometimes even improved.

In the present invention, "graft percent" refers to the weight increase based on the weight of original fiber due to grafting with acrylic acid. The graft percent is required to be at least 15% for making polyethylene fiber fire retardant and self-extinguishing. In case of less than 15%, the fire retardance and self-extinguishing nature are insufficient in effect. And at least 20%, preferably 30%, of graft percent is necessary for making the fiber heat resistant. In the case of less than 20%, sufficient heat resistance is not obtained. The heat resistance is not improved even by increasing the graft rate for there is no upper limit. Considering the fire retardant effect together with the heat resistance and change of strength properties of fiber by graft polymerization, the appropriate graft rate is up to 100%, preferably up to 60%. With such range of graft rate, a polyethylene fiber which is satisfactory in fire retardance, heat resistance, and dyability as well as hydrophilic nature can be obtained.

The process of the present invention is particularly effective for making fibrous polyethylene heat resistant. Heretofore, the graft polymerization to polyethylene in powder, sheet and film has been known. A method of improving the adhesive properties of polyethylene to metal by radiation graft polymerizing powdery polyethylene with acrylic acid in a solution of organic solvent having a high swelling effect for polyethylene such as benzene, toluene, etc. and a method of manufacturing an ion-exchange membrane by graft polymerizing sheet-like or film-like polyethylene using an acrylic acid aqueous solution have hitherto been known.

Differing from the known prior art, the process of the present invention serves to graft polymerize fibrous polyethylene with acrylic acid, or further, after graft polymerization, converting to a metal salt of polyacrylic acid, to improve the fire retardance and/or heat resistance of the fiber. Prevention of heat shrinkage and heat breaking and enhancement of hygroscopity are particularly necessary for fibers. Fibrous materials are high in degree of orientation of the molecular chain and the degree of crystallization since they are generally subjected to extension treatment after spinning, and, therefore, they are difficult to be graft polymerized in comparison with powdery, sheet-like or film-like material to produce a large amount of homopolymer outside of the fiber in the process of graft polymerization. Such homopolymer causes adhering of one fiber to another which damages the quality of the fiber. According to the process of the present inventiion, acrylic acid can be graft polymerized to polyethylene fiber without forming homopolymer.

The resulting graft fiber is remarkably increased in heat resistance. For example, a fiber grafted with 33.5%, based on the weight of original fiber, of acrylic acid and converted to sodium salt had a maximum of 12% in the degree of shrinkage even when heating to 300° C. and was not broken on heating to 300° C. whereas a polyethylene fiber was shrunk by 50% based on the original length on heating under a load of 0.01 g/denier and melted to be broken at 136° C. And the polyethylene thus treated could be deeply dyed with cationic dyes Cevron Brilliant Red B. This fiber was 15% in hygroscopicity in an atmosphere of 25° C. and 66% RH so that the fiber proved to be rendered hydrophilic. And in the conversion treatment to a metal salt after acrylic acid graft polymerization, the strength of fiber was scarcely changed.

The polyethylene fiber used in the process of the present invention is of various crystallinities of 0.93 to 1.00 in density, and is used as a filament, short fiber or knitted web.

The present invention will be explained in greater detail in the following Examples in which the percentages are by volume for monomer mixed solution and by weight for others. The Examples will be described with reference to the attached drawing.

DESCRIPTION OF THE DRAWING

The FIGURE shows an apparatus for determing the burning properties of a fiber by the basket method in the present invention, wherein numerals 1,2,3 and 4 respectively show a basket, a sample, a micro-burner and a receiver for material melted to droplets.

EXAMPLES

Example 1

0.5 g of polyethylene filament (fineness of fiber: 337 denier; density: 0.95) was washed with distilled water, dried under vacuum, and placed into a polymerization tube of 1 cm in inner diameter made of glass. 10 ml of mixed solution of acrylic acid, water and ethylene dichloride in a volume ratio of 50:25:20 was supplied with Mohr's salt (ammonium ferrous sulfate) in an amount of $4\times10^{-3}$ mole/l and air was purged with nitrogen for 2 minutes and the polymerization tube was heat-sealed. It was irradiated with $\gamma$-rays from $^{60}Co$ with a dose of $2.9\times10^{5}$ rad, at 40° C. The filament was withdrawn from the polymerization tube and washed with water at 50° C. to remove unreacted monomer, solvent and water soluble homopolymer. The weight increase of fiber by such treatment, i.e. graft percent, was 21.5%.

The grafted fiber was heated to 150° C. and 200° C. with a rate of temperature rise of 2° C. per minute in an atmosphere of air under a load of 0.01 g/denier. The degree of shrinkage was 53% and 60% respectively. When heating at 220° C., the fiber was melted and broken.

The original polyethylene fiber began to shrink at 65° C., reached 50% in degree of shrinkage at 130° C. and was melted and broken at 135° C.

For comparison, the polyethylene fiber was irradiated with an electron beam with 10 Mrad under vacuum. The electron beam used was generated from a Van de Graf accelerator and the irradiation was performed under a condition of 1.5 MV, 50 $\mu$A current and 0.2 Mrad/second dose rate. The resistance to heat shrinkability of polyethylene cross-linked by irradiation was examined. The cross-linked polyethylene filament began to shrink at 80° C., reached 85% in the degree of shrinkage at 135° C., which was 85 to 86% even at 150° C. and 225° C. were 83% to 84% and 81%, respectively.

The grafted fiber was excellent in dyeability. The original polyethylene fiber was not dyed with a cationic dye, Cevron Brilliant Red B, at all, but the grafted fiber was dyed brilliantly with it. As the result of measurements at 23° C. and 65% RH using an Instron tester, the grafted polyethylene fiber was 5.14 g/denier in tenacity, and 22.5% in elongation while its strength was 2.09 Kg and its degree of fineness was the 408 denier whereas the original fiber was 2.19 kg in strength, 337 denier in fineness and 25.9% in elongation. Thus, it is apparent that the strength and elongation were scarcely changed by graft polymerization. Incidentally, since the fineness of the filament is increased by graft polymerization, the strength which is expressed in tenacity, i.e., in g/d was reduced by the grafting.

It is evident from these tests that, according to the process of the present invention, a polyethylene fiber can be substantially improved in resistance to heat shrinkability and heat resistance (melting and breaking temperature) without damaging the strength properties and additionally can be given dyeability.

Example 2

A graft polymerization of polyethylene filament with acrylic acid was carried out under the same conditions as in Example 1 except using 50° C. as an irradiation temperature instead of 40° C. The graft percent was 33.5%. The temperature was increased in air in the same manner as in Example 1 and the degree of shrinkage was measured. The degree of shrinkage at 150° C. and 200° C. were 50% and 54%, respectively. When further heated it was melted and broken at 220° C. The grafted fiber was 5.26 kg/denier in strength per denier and 23.3% in elongation since its strength was 2.31 kg and its fineness was 439 denier. As is evident from the above described result, the grafted polyethylene fiber was remarkably improved in resistance to heat shrinkability and melting and breaking temperature in comparison with the original polyethylene fiber without damaging its strength properties.

EXAMPLE 3

The fiber of 21.5% graft percent obtained in Example 1 was treated with an aqueous solution of 1% calcium acetate at 50° C. for 8 hours to convert the grafted polyacrylic acid to the calcium salt.

The resistance to heat shrinkability of the calcium salt treated fiber so obtained was measured in the same manner as in Example 1. The degree of shrinkage at 150° C. and 200° C. were 24% and 35%, respectively, and the fiber was melted and broken at 280° C. The maximum shrinkage up to 280° C. was only 36%. The fiber proved to be brilliantly dyed with cationic dye, Cevron Brilliant Red B.

The calcium salt treated fiber was 2.19 kg in strength, 425 denier in finess, 5.15 g/denier in strength per denier and 27.4% in elongation.

As is evident from this result, the calcium salt treated fiber was remarkably improved in resistance to heat shrinkability and melting and breaking temperature in comparison with the original polyethylene fiber and the strength properties were not damaged by the converting operation to the salt.

EXAMPLE 4

The fiber of 33.5% graft percent obtained in Example 2 was converted to the calcium salt in the same manner as in Example 3. The resistance to heat shrinkability of the calcium salt treated fiber so obtained was measured in the same manner as in Example 1. The degree of shrinkage at 150° C. and 200° C. were 10% and 20%, respectively. When further heating to 300° C., the degree of shrinkage was 10% and the fiber was not broken. The calcium salt treated fiber was 4.76 g/denier in strength per denier and 22.5% in elongation since its strength was 2.28 kg and its fineness was 479 denier.

As is evident from this result, the resistance to heat shrinkability and melting and breaking temperature were remarkably improved in comparison with those of the original polyethylene fiber and the strength properties were scarcely damaged by the converting operation to the salt.

Comparative Example 1

The graft polymerization of polyethylene filament with acrylic acid was performed under the same conditions as in Example 1 except the irradiation time was 12 hours instead of 16 hours. The graft percent was 18.5%. As a result of testing, the resistance to heat shrinkability, the degree of heat-shrinkage at 150° C. and 180° C. were 60% and 72%, respectively. When heating at a temperature above 180° C. this grafted fiber began to decrease in the degree of heat-shrinkage and was melted and broken at 205° C. The grafted fiber was relatively improved in heat resistance in comparison with the original polyethylene fiber, but it is not always sufficient.

EXAMPLE 5

The acrylic acid grafted polyethylene filament of 33.5% in graft percent prepared in Example 2 was treated with an aqueous solution of 1% lithium carbonate at 50° C. for 8 hours to convert the polyacrylic acid to lithium salt. The degree of heat-shrinkage at 150° C. and 200° C. were 13% and 14%, respectively, and it was not broken even at 300° C. The strength was 2.30 kg.

Example 6

The acrylic acid grafted polyethylene filament of 33.5% in graft rate was converted to the potassium salt using potassium carbonate instead of converting to the lithium salt in Example 5. The degree of heat-shrinkage at 150° C. and 200° C. were 9% and 11%, respectively, and it was not broken when heated to 300° C. The strength was 2.12 kg.

Example 7

The acrylic acid grafted polyethylene filament with 33.5% in graft percent was converted to the sodium salt using sodium carbonate instead of converting to lithium salt in Example 5. The degree of heat-shrinkage at 150° C. and 200° C. were 11% and 13% respectively, and it was not broken when heated to 300° C. The strength was 2.25 kg.

Example 8

The potassium acrylate grafted polyethylene filament obtained in Example 6 was immersed into an aqueous solution of 1% magnesium sulfate and treated at 50° C. for 8 hours to convert to the magnesium salt. The degree of heat-shrinkage at 150° C. and 200° C. were 14% and 17%, respectively, and it was not broken when heated to 300° C. The strength was 2.30 kg.

Example 9

Instead of using an aqueous solution of magnesium sulfate to convert to the magnesium acrylate grafted filament in Example 8, an aqueous solution of strontium chloride was used for converting to the strontium acrylate grafted filament. The degree of heat-shrinkage at 150° C. and 200° C. were 13% and 17% respectively, and it was not broken when heated to 300° C. The strength was 2.25 kg.

Example 10

Instead of coverting to the magnesium acrylate grafted filament in Example 8, an aqueous solution of zinc chloride was used for converting to the zinc acrylate grafted filament. The degree of heat-shrinkage at 150° C. and 200° C. were 12% and 14% respectively, and it was not broken when heated to 300° C. The strength was 2.10 kg.

Example 11

Instead of converting to the magnesium acrylate grafted filament in Example 8, an aqueous solution of barium chloride was used for converting to the barium acrylate grafted filament. The degree of heat-shrinkage at 150° C. and 200° C. were 11% and 14% respectively, and it was not broken when heated to 300° C. The strength was 2.18 kg.

Example 12

Instead of converting to the magnesium acrylate grafted filament in Example 8, an aqueous solution of 5% aluminum acrylate was used for converting to the aluminium acrylate grafted filament. The degree of heat-shrinkage at 150° C. and 200° C. were 10% and 11%, respectively, and it was not broken when heated to 300° C. The strength was 2.22 kg.

Example 13

Instead of using a mixed solution of acrylic acid-water-ethylene dichloride in Example 1, the graft polymerization to polyethylene filament was performed using a mixed solution of acrylic acid-water in a a volumetric ratio of 50:50 by the same operation as in Example 1. When irradiating with $\gamma$-rays with a dose rate of $1.8\times10^4$ rad/hour at an irradiation temperature of 70° C. for 7.5 hours, an acrylic acid grafted filament of 34.4% in graft was obtained. After converting this grafted filament to the calcium salt by the same operation as in Example 3, the resistance to heat shrinkability was tested. The degree of heat-shrinkage at 150° C. and 200° C. were 10% and 12%, respectively, and when heated to 300° C., the degree of heat-shrinkage was below 13% and the filament was not broken the strength was 2.19 kg.

Example 14

The polyethylene filament as in Example 4 was irradiated with an electron beam of 1.5 MW and 50 μA from a Van de Graft accelerator to be given a dose of 10 Mrad. Then the filament was immersed into a solution of acrylic acid-water-ethylene dichloride containing $4\times10^{-3}$ mole/l of Mohr's salt in the same composition as in Example 1 and heated at 80° C. for 1.5 hours in an atmosphere of nitrogen to obtain a grafted filament of 33.9% graft percent. After converting to the calcium salt by the same operation as in Example 3, the resistance to heat shrinkability was tested. The degree of heat-shrinkage at 150° C. and 200° C. were 10% and 11%, respectively, and when heated to 300° C. the degree of heat-shrinkage was a maximum of 12% and the filament was not broken. The strength was 2.07 kg.

Example 15

About 0.5 g of polyethylene fiber (fineness 10 deniers, density 0.96) was washed with distilled water, dried under vacuum, placed into a polymerization tube of 1 cm inner diameter made of glass and supplied with an acrylic acid mixed solution having the same composition as in Example 1. After purging air with nitrogen, the polymerization tube was heat sealed. It was irradiated with γ-rays from $^{60}$Co with a dose rate of $3.0\times10^5$ rad to obtain a fiber of 31.5% graft percent. The degree of heat-shrinkage at 150° C. and 200° C. were 26% and 34%, respectively, and it was first broken when it was heated to 285° C.

Example 16

About 0.5 g of polyethylene filament (fineness 337 deniers, density 0.95) was washed with distilled water, dried under vacuum and placed into a polymerization tube of 1 cm inner diameter made of glass. 10 ml of mixed solution of acrylic acid-water-ethylene dichloride in volumetric ration of 50:25:25 containing Mohr's salt (ammonium ferrous sulfate) in an amount of $4\times10^{-3}$ mole/l was added thereto so that the filament was immersed in the solution. After purging air with nitrogen, the polymerization tube was heat-sealed and then was irradiated with γ-rays from $^{60}$Co with a dose rate of $1.8\times10^4$ rad/hour for 3 hours, i.e. with a dose of $5.4\times10^4$ rad, while heating at 60° C.

The filament was withdrawn from the polymerization tube and washed with warm water at 50° C. to remove unreacted monomer, solvent and water soluble homopolymer. The weight of filament increased by such treatment, i.e. graft percent was 18.5%.

Then, the acrylic acid grafted fiber was tested for fire-resistance by means of the basket method burning test. The test method is as follows:

In FIG. 1, 0.3 g of a sample 2 was placed into a basket 1 made of 40 mesh wire cloth and contacted with a flame 3 of 60 mm length from a micro-burner for 10 seconds. After removing the flame, the surviving time of the flame on the fiber, the amount of material melted to drop down onto a receiving pan 4 and the amount of material remaining unburned in the basket were determined.

When testing a sample of 18.5% graft precent by this method, the flame of the sample extinguished 7.0 seconds after removing the flame so that it was recognized to have self-extinguishing properties. The amount of material remaining unburned in the basket was 88.1% based on the weight of sample before the burning test. Furthermore, it was confirmed that melting to droplets did not occur.

For comparison, the burning test was performed on untreated polyethylene filament. The filament continued to burn while accompanied by melting to droplets even after removing the flame and the polyethylene filament in the basket was completely burned. The surviving time of flame was 49.4 seconds, no trace of unburned material remaining in the basket was found and the amount of material melted to droplets as 62.7%.

Therefore, it is clear that polyethylene filament can be made flame-retardant by graft polymerizing acrylic acid and will resist melting to droplets.

For comparison, when graft polymerizing polyethylene filament with acrylic acid under the same conditions as in Example 16 except that the irradiation time of γ-rays was 2.0 hours, the graft percent of filament obtained was 11.4%. The results of the burning test of the filament are as follows: Even after removing the flame the filament continued to burn so that melting to droplets could not be absolutely prevented and so the self-extinguishing properties were not obtained.

For a graft percent less than 15%, the fire-retardance and the prevention of melting is insufficient although they are improved when compared with the original filament. It is found that at least 15% in graft percent is required.

Example 17

A graft polymerization was performed using polyethylene filament under the same conditions as in Example 16 except the irradiation time was 4.5 hours to obtain a filament of 24.8% in graft.

This filament was tested as to its flammability by the basket method to obtain the following results: The flame of the filament extinguished 5.2 seconds after removing the flame so that it was recognized to have self-extinguishing properties. The amount of material remaining unburned in the basket was 84.5% based on the weight before the burning test. And it was confirmed that there is no melting.

Examples 18 To 20

For the same polyethylene filament as used in Example 16, using a solution of acrylic acid-water (50:50 in volume ratio) instead of acrylic acid-water-ethylene dichloride (50:20:25 in volume ratio), γ-rays were irradiated for 7.5 hours, 10.0 hours and 16.0 hours in the same operation as in Example 16 to obtain filaments of 32.0%, 39.3% and 50.0%, respectively, in graft percent. The burning test results of the filaments by the basket method are shown in Table 1.

TABLE 1

| Example | Graft percent % | Surviving time of flame seconds | Amount of material remaining in basket % | Amount of material melted to droplets % | Self-extinguishing properties |
|---|---|---|---|---|---|
| 3 | 32.0 | 2.2 | 84.5 | 0 | have |
| 4 | 39.3 | 5.0 | 88.5 | 0 | have |
| 5 | 50.5 | 4.0 | 85.5 | 0 | have |

Example 21

A filament of 24.8% in graft percent obtained in Example 17 was treated with an aqueous solution of 1% calcium acetate at 50° C. for 8 hours to convert the grafted polyacrylic acid to the calcium salt.

This calcium salt treated fiber was determined as to its burning properties by the basket method. The flame extinguished itself 2.2 seconds after removal of the applied flame so that the fiber was recognized to have self-extinguishing properties. The amount remaining unburned in the basket was 77.0% and there was no melting.

Example 22

A filament of 32.0% in graft percent obtained in Example 18 was converted to the calcium salt in the same manner as in Example 21.

This calcium salt treated fiber was determined as to its burning properties by the basket method. The flame of the sample extinguished itself 4.0 seconds after removing the flame so that it was recognized to have self-extinguishing properties. The amount of material remaining unburned in the basket was 72.0% and there was no melting.

Example 23

A filament of 39.3% in graft percent obtained in Example 19 was converted to the calcium salt in the same manner as in Example 21.

The calcium salt grafted fiber was determined as to its burning properties by the basket method. The flame extinguished itself 2.0 seconds after removal of the applied flame so that the fiber was recognized to have self-extinguishing properties. The amount of material remaining unburned was 48.0% and there was no melting.

Example 24

A filament of 39.3% in graft percent obtained in Example 19 was treated with an aqueous solution of 1% potassium carbonate at 50° C. for 8 hours to convert it to the potassium salt. Then, the potassium acrylate grafted filament was immersed in an aqueous solution of 1% magnesium sulfate at 50° C. for 8 hours to convert to the magnesium salt. The burning properties of this filament were determined by the basket method. This filament flamed out immediately after removing the applied flame, smoked for about 2.5 minutes and extinguished itself after residual glowing a while. The amount of material remaining unburned in the basket was 62.5% and there was no melting.

Example 25

A filament of 39.3% in graft percent obtained in Example 19 was converted to the potassium acrylate grafted filament in the same manner as in Example 24 and thereafter converted to the strontium acrylate grafted filament using an aqueous solution of 1% strontium chloride. The burning properties of this filament were determined by the basket method. The flame of the sample extinguished itself 2.0 seconds after removing the applied flame so that it was recognized to have self-extinguishing properties. The amount of material remaining unburned in the basket was 43.0% and there was no melting.

Example 26

A filament of 39.3% in graft percent obtained in Example 19 was converted to the potassium acrylate graft filament in the same manner as in Example 24 and thereafter converted to the barium acrylate grafted filament using an aqueous solution of 1% barium chloride. The burning properties of this filament were tested. The flame of the fiber was extinguished 5.0 seconds after removing the applied flame so that the fiber was recognized to have self-extinguishing properties. The amount of material remaining unburned in the basket was 45.6% and there was no melting.

Example 27

The same polyethylene filament as in Example 16 was irradiated with an electron beam of 1.5 MV and 50$\mu$ in current in air to give a dose of 10 Mrad.

The polyethylene filamet was graft polymerized by immersing it in a solution of acrylic acid-water-ethylene dichloride (containing $4\times10^{-3}$ mole/l of Mohr's salt) in the same composition as in Example 16, and heating it at 80° C. in an atmosphere of nitrogen for 1.0 hour to obtain a filament of 34.1% in graft percent. The burning properties of this filament were determined by the basket method. The flame of the sample extinguished 3.6 seconds after removing the applied flame so that it was recognized to have self-extinguishing properties. The amount of material remaining unburned in the basket was 87.0% and there was no melting.

What is claimed is:

1. A process for preparing a heat resistant and/or fire retardant synthetic fiber comprising contacting a polyethylene fiber with a mixture comprising acrylic acid, water, ethylene dichloride and a salt selected from the group consisting of ferrous ammonium sulfate, copper sulfate and cuprous chloride, and irradiating said polyethylene fiber with an ionizing radiation at a temperature of 40° to 80° C. to graft polymerize said polyethylene fiber with at least 15% of the acrylic acid based on the weight of said polyethylene fiber, the combination of the contacting of the polyethylene fiber with the acrylic acid mixture and its irradiation with the ionizing radiation at said temperature being effective to confer heat resistance and/or fire retardation to the fiber.

2. A process for preparing a heat resistant and/or fire retardant synthetic fiber comprising irradiating a polyethylene fiber with an ionizing radiation and then contacting said polyethylene fiber with a mixture comprising acrylic acid, water, ethylene dichloride and a salt selected from the group consisting of ferrous ammonium sulfate, copper sulfate and cuprous chloride, at a temperature of 40° to 80° C. to graft polymerize said polyethylene fiber with at least 15% of the acrylic acid based on the weight of said polyethylene fiber, the combination of the contact of the polyethylene fiber with the acrylic acid mixture at said temperature and its irradiation with the ionizing radiation being effective to confer heat resistance and/or fire retardation to the fiber.

3. A heat resistant and/or fire retardant polyethylene fiber prepared according to the process in claim 1 or 2.

4. The process as claimed in claim 1 or 2 which further comprises treating the acrylic acid grafted polyethylene fiber with an aqueous solution of a metal salt to convert the grafted polymer to a polyacrylic acid salt of the metal, the fire retardant effect of the fiber being retained after the salt conversion.

5. The process as claimed in claim 4 wherein said metal is a monovalent metal selected from the group consisting of lithium, potassium and sodium.

6. The process as claimed in claim 4 wherein said metal is a divalent metal selected from the group consisting of magnesium, calcium strontium, barium and zinc.

7. The process as claimed in claim 4 wherein said metal is aluminum.

8. The process as claimed in claim 1 wherein the contacting of the polyethylene fiber with the acrylic acid mixture is effected by immersing the fiber into the mixture.

9. The process as claimed in claim 1 wherein the contacting of the polyethylene fiber with the acrylic acid mixture is effected by impregnating the fiber with said mixture.

10. The process as claimed in claim 1 or 2 wherein the irradiation is effected at a temperature between 40° C. and 80° C. at a dose rate and dose as follows:

| radiation | dose rate | dose |
|---|---|---|
| election beam | $10^4$ to $10^7$ rad/sec | $1 \times 10^3$ to $1 \times 10^7$ rad |
| γ-rays or X-rays | $10^3$ to $10^6$ rad/sec | $1 \times 10^6$ to $1 \times 10^7$ rad |

11. The process as claimed in claim 1 or 2 wherein the obtained fiber has dyeability properties and the process further comprises dyeing the fiber with a cationic dye.

12. A process as claimed in claim 1 or 2 wherein the salt is ferrous ammonium sulfate.

13. A process as claimed in claim 12 wherein the concentration of salt is up to $10^{-1}$ mole/l of the weight of said mixture.

14. A process as claimed in claim 1 or 2 wherein said combination is effected to confer heat resistance and/or fire retardation to the fiber while providing high shrinkability resistance, high breakage resistance, and high melting temperature, the degree of shrinkage being no greater than 60% at 150° C., the breaking temperature being no less than 205° C., the melting temperature being no less than 205° C., the heat resistance and/or fire retardation being measured by a self extinguishing property determined by an extinction time of a surviving flame of the fiber of less than 7 seconds, an unburned amount of material of at least 43% after burning and no melting of the fiber to form droplets at a flame temperature.

* * * * *